US006932463B2

(12) United States Patent
Ito

(10) Patent No.: US 6,932,463 B2
(45) Date of Patent: Aug. 23, 2005

(54) INK-JET PRINTHEAD AND METHOD OF MANUFACTURING THE SAME

(75) Inventor: Atsushi Ito, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 10/439,965

(22) Filed: May 15, 2003

(65) Prior Publication Data

US 2003/0222946 A1 Dec. 4, 2003

(30) Foreign Application Priority Data

May 28, 2002 (JP) ..... 2002-154350

(51) Int. Cl.[7] ..... B41J 2/045
(52) U.S. Cl. ..... 347/68
(58) Field of Search ..... 347/68, 70, 71, 347/72

(56) References Cited

U.S. PATENT DOCUMENTS 5,402,159 A 3/1995 Takahashi et al.
5,670,999 A 9/1997 Takeuchi et al.
6,033,058 A * 3/2000 Usui et al. ..... 347/71
6,604,817 B2 * 8/2003 Isono et al. ..... 347/71
2001/0020968 A1 9/2001 Isono et al.

FOREIGN PATENT DOCUMENTS

| | | |
|---|---|---|
| EP | 0 931 656 A1 | 7/1999 |
| JP | 2-882245 | 3/1990 |
| JP | 2841397 B2 | 6/1990 |
| JP | 3079688 B2 | 4/1993 |
| JP | 2000 135789 | 5/2000 |
| JP | 2002-36545 | 2/2002 |

* cited by examiner

*Primary Examiner*—Anh T. N. Vo
(74) *Attorney, Agent, or Firm*—Reed Smith LLP

(57) ABSTRACT

A flat ink-jet printhead includes a cavity unit having an array of nozzles and pressure chambers each storing ink and communicating with a corresponding one of the nozzles, and a piezoelectric actuator shaped like a plate. The piezoelectric actuator has active portions each provided for a corresponding one of the pressure chambers and selectively driven to pressurize the ink in the pressure chambers. The piezoelectric actuator is stacked on and bonded to a surface formed with the pressure chambers of the cavity unit. In addition, a straightening member shaped like a frame is bonded to the same surface of the cavity unit to enclose the circumference of the piezoelectric actuator. The straightening member corrects warping of the piezoelectric actuator and the cavity unit when they are bonded using the same thermosetting adhesive.

28 Claims, 7 Drawing Sheets

INK-JET PRINTHEAD AND METHOD OF MANUFACTURING THE SAME

BACKGROUND OF THE INVENTION

1. Field of Invention

The invention relates to a piezoelectric ink-jet printhead that is flat in shape and to a manufacturing method of the same.

2. Description of Related Art

U.S. Patent Publication No. 2001/0020968 and Japanese Laid-Open Patent Publication No. 2002-36545, both of which are incorporated herein by reference, disclose an on-demand type ink-jet printhead having a cavity unit and a piezoelectric actuator. The cavity unit is formed by stacking a plurality of manifold plates under a base plate having pressure chambers, by placing a nozzle plate at the bottom of the manifold plates, and by bonding theses plates using an adhesive. The piezoelectric actuator in the form of a flat plate is bonded to the upper surface of the base plate of the cavity unit such that piezoelectric elements of the piezoelectric actuator face the pressure chambers formed in the base plate.

With this structure, the piezoelectric actuator and the cavity unit are arranged to overlap each other within the area of the ink-jet printhead in the plan view thereof. Thus, the ink-jet printhead is advantageously made compact.

With this structure, however, because the cavity unit is formed by laminating a plurality of metal plates while the piezoelectric actuator is formed by laminating a plurality of ceramic sheets, the cavity unit expands more than the piezoelectric actuator does when they are thermally bonded. The cavity unit and the piezoelectric actuator are bonded by applying a thermosetting adhesive, such as epoxy resin, therebetween and by heating. When the piezoelectric actuator and the cavity unit are cooled down after the adhesive is hardened to fix the piezoelectric actuator to the upper surface of the cavity (surface with pressure chambers), contraction of the cavity unit is restricted on its upper surface because the piezoelectric actuator having a low linear expansion coefficient is bonded thereto. On the other hand, the cavity unit contracts greatly on its lower surface (surface with nozzles). As a result, the cavity unit is concavely curved on the nozzle side. Conversely, the cavity unit is convexedly curved on the piezoelectric actuator side. Such concave curving is remarkable in the longitudinal direction of the cavity unit, that is, in the direction of the nozzle array. Because ink is ejected in a direction perpendicular to the curved lower surface of the cavity unit, the quality of an image formed on a recording sheet may be degraded.

SUMMARY OF THE INVENTION

The present invention addresses the foregoing problems and provides an ink-jet printhead that are unlikely to suffer warping during the bonding process and able to accomplish high-quality printing.

According to one aspect of the invention, an ink-jet printhead includes a cavity unit having an array of nozzles and pressure chambers each storing ink and communicating with a corresponding one of the nozzles, and an actuator shaped like a plate. The actuator has active portions each provided for a corresponding one of the pressure chambers and selectively driven to pressurize the ink in the pressure chambers. The actuator is stacked on and bonded to a surface formed with the pressure chambers of the cavity unit. The ink-jet print head also includes a straightening member bonded to the surface formed with the pressure chambers of the cavity unit. The straightening member encloses at least two sides of the actuator along at least a longitudinal direction of the cavity unit.

Such an ink jet printhead is manufactured in the following steps. A cavity unit that has an array of nozzles and pressure chambers each communicating with a corresponding one of the nozzles is provided. An actuator shaped like a plate and having active portions that are selectively driven is provided. A straightening member having two linear portions is formed. Then, the actuator and the straightening member are bonded to a surface formed with the pressure chambers of the cavity unit, using a thermosetting adhesive, such that the straightening member encloses with the two linear portions at least two sides of the actuator along at least a longitudinal direction of the cavity unit and that each of the active portions is positioned at a corresponding one of the pressure chambers.

According to another aspect of the invention, the straightening member is substantially equal in linear expansion coefficient to the cavity unit, or a difference in linear expansion coefficient between the straightening member and the actuator is greater than a difference in linear expansion coefficient between the cavity unit and the actuator.

BRIEF DESCRIPTION OF THE DRAWINGS

Preferred embodiments of the invention will be described in detail with reference to the following figures, in which like elements are labeled with like numbers and in which.

DETAILED DESCRIPTION OF PREFERRED EMBODIMENT

Figure 1:
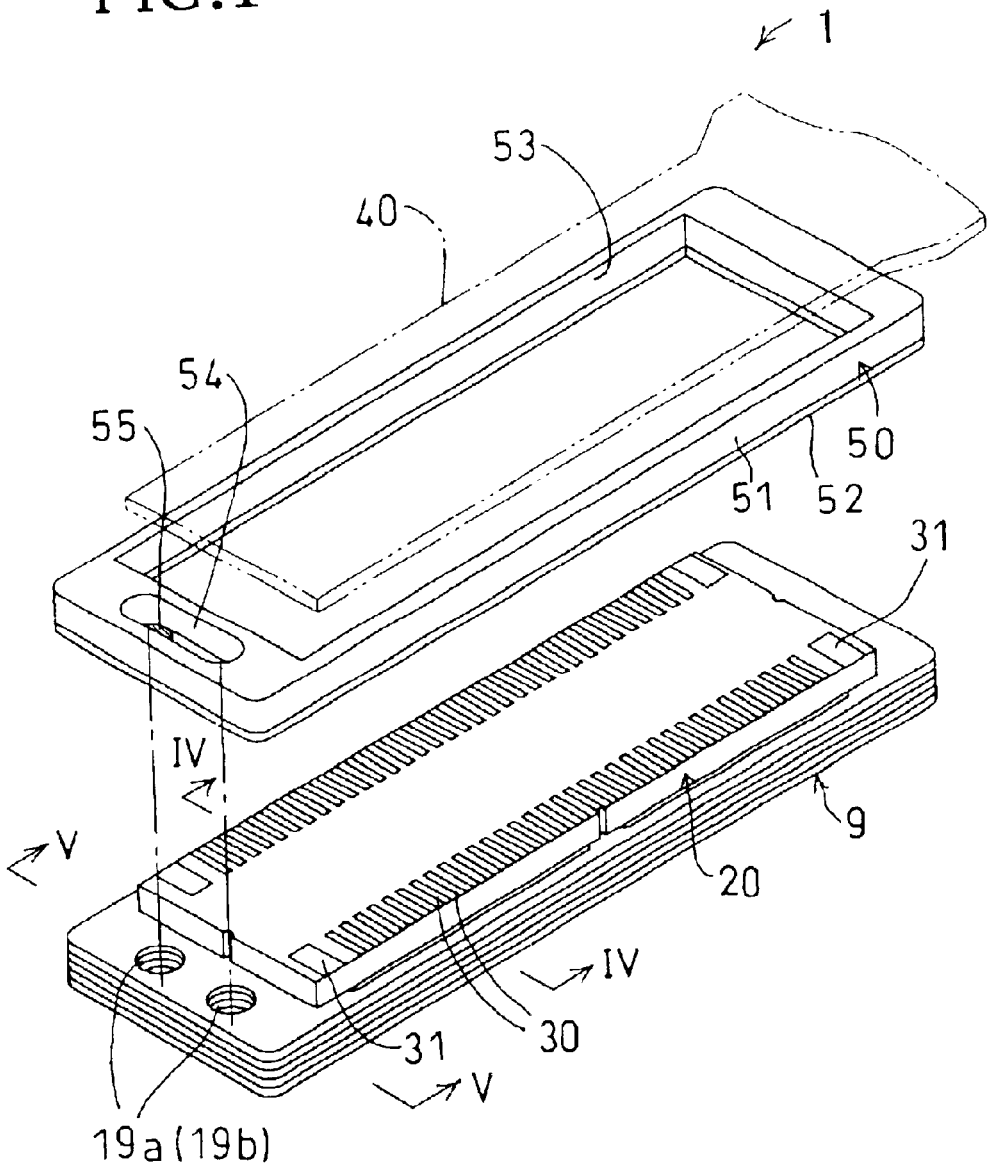
FIG. 1 is an exploded perspective view of a piezoelectric ink-jet printhead according to a first embodiment of the invention.

An ink-jet printhead 1 according to a first embodiment of the invention will be described with reference to FIGS. 1 through 5. A frame-shaped straightening member 50, which will be described later, is bonded using an adhesive to an upper surface of a cavity unit 9 so as to enclose the circumference of a plate-shaped piezoelectric actuator 20. A flexible flat cable 40 is bonded using an adhesive to an upper surface of the piezoelectric actuator 20 for connection with external devices. Ink is ejected from nozzles open at a lower surface of the cavity unit 9.

Figure 2:
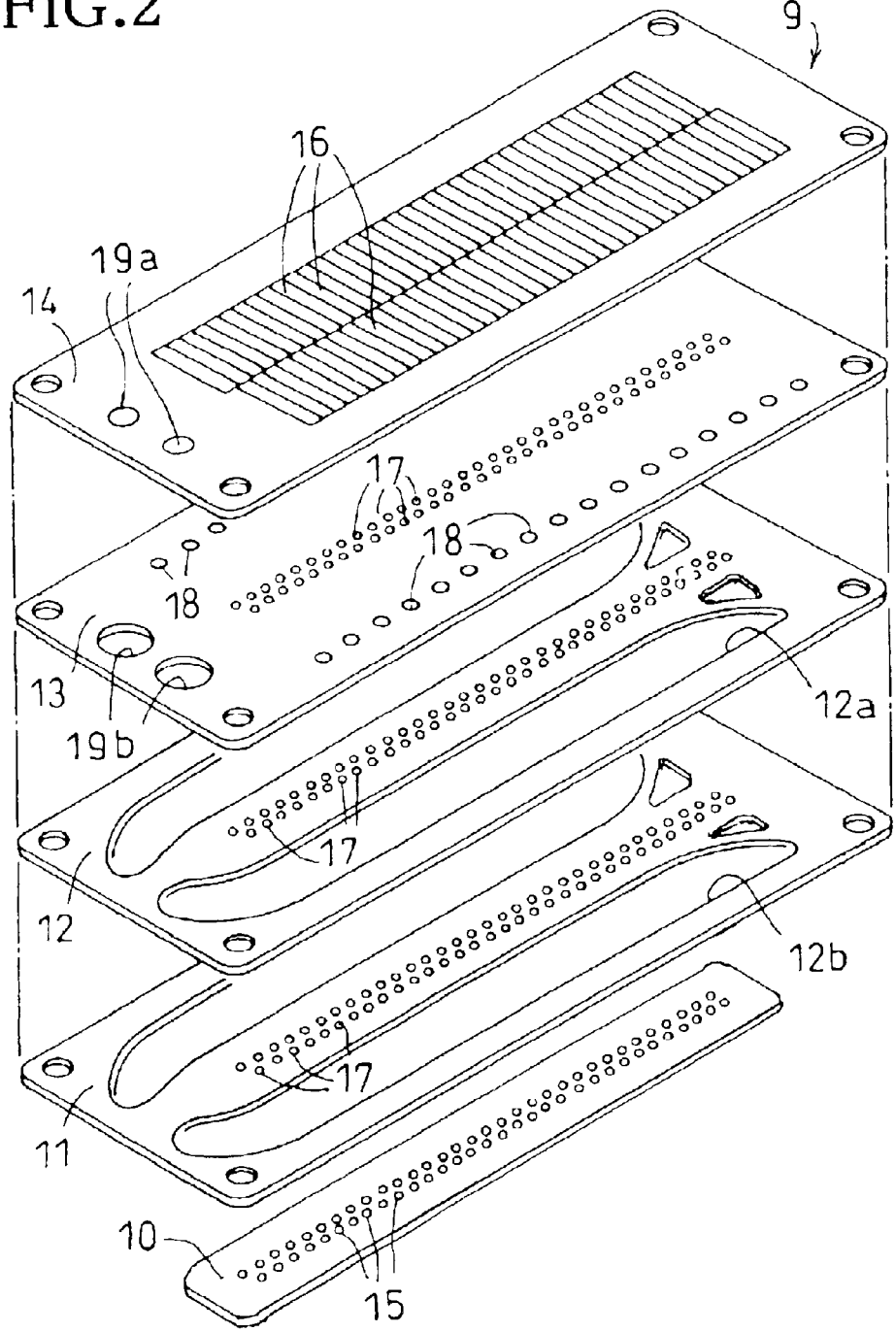
FIG.2 is an exploded view of a cavity unit of the piezoelectric ink-jet printhead.
Figure 3:
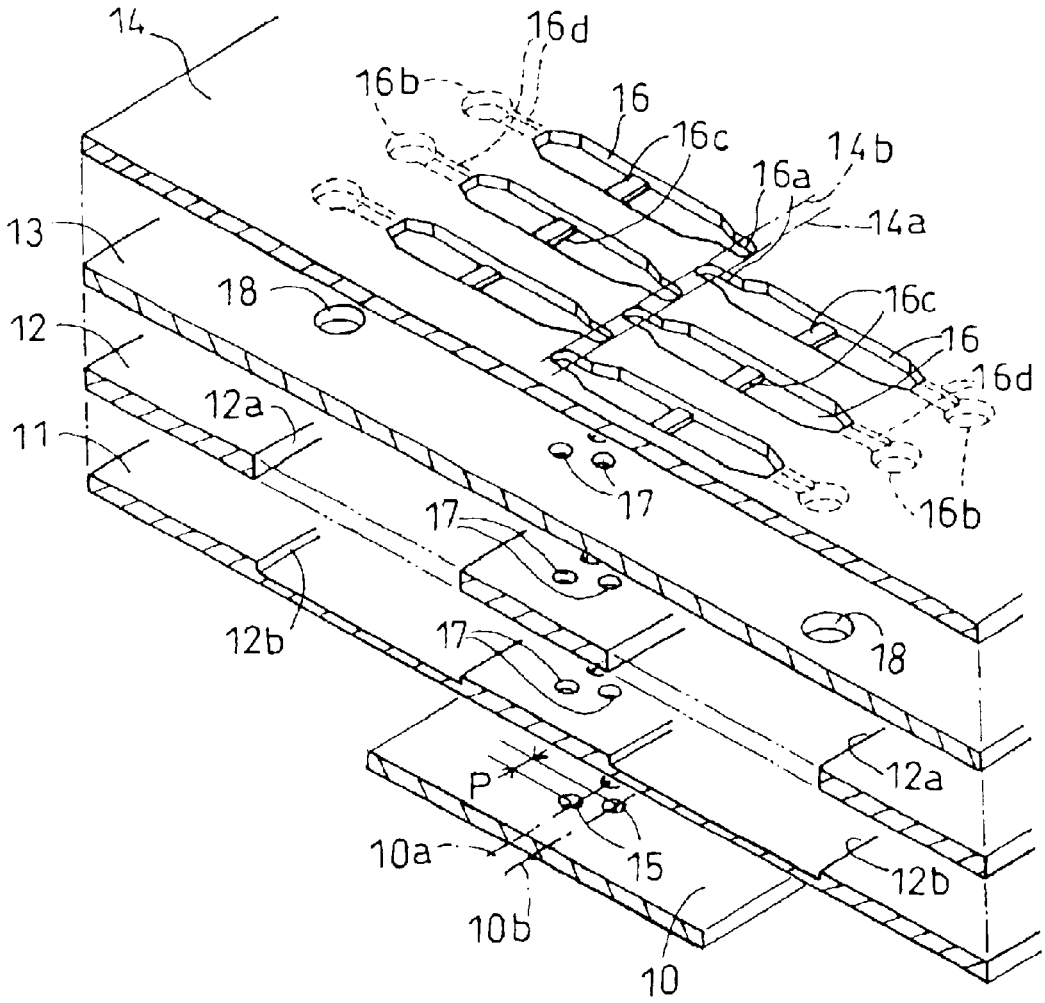
FIG. 3 is a partially enlarged perspective view of the cavity unit.
Figure 4:
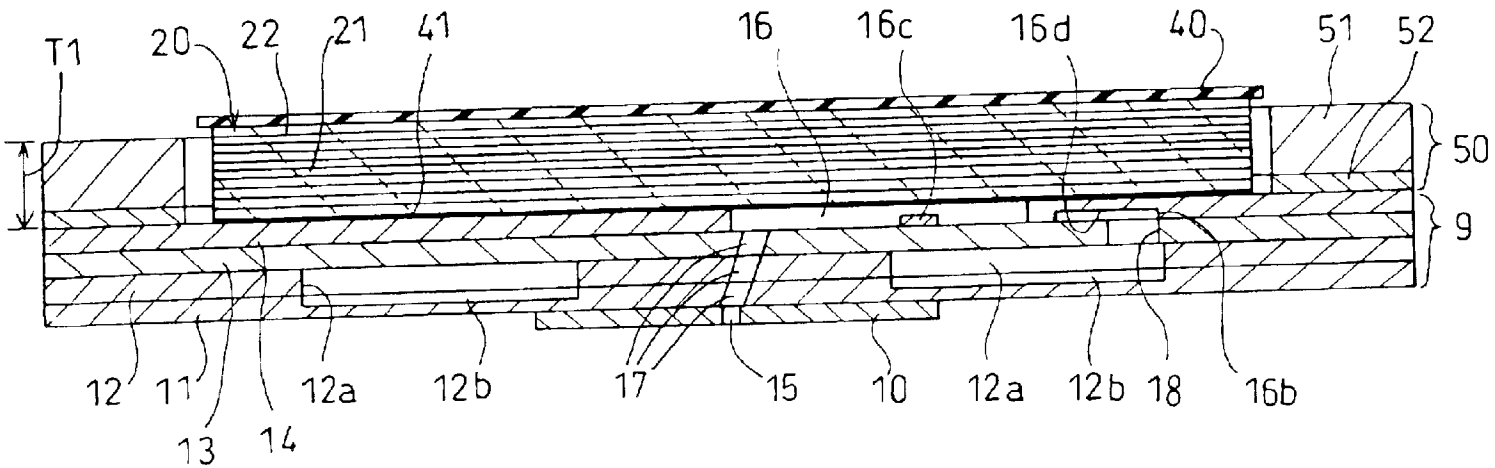
FIG. 4 is an enlarged sectional view taken along line IV—IV of FIG. 1.

The structure of the cavity unit 9 will be described with reference to FIGS. 2 through 5. The cavity unit 9 is formed by laminating and bonding using an adhesive five thin plates, that is, a nozzle plate 10, two manifold plates 11, 12, a spacer plate 13, and a base plate 14. In this embodiment, each plate 12, 13, 14, except for the synthetic resin nozzle plate 10, is made of stainless steel and has a thickness of about 50–150 μm. A plurality of nozzles 15 having a very small diameter (about 25 μm) are formed for ink ejection in the nozzle plate 10 in a first (longitudinal) direction in two rows in a staggered configuration. These nozzles 15 are arranged with a very small pitch P, along two reference lines 10*a*, 10*b* that extend in parallel with the first direction. Manifold chambers 12*a*, 12*b* are formed in the manifold plates 12, 11, respectively, to extend on both sides of the nozzle arrays. The manifold chambers 12*a*, 12*b* serve as ink passages and store the ink supplied from an external ink source and supplies the ink to pressure chambers 16, which will be described later. As shown in FIGS. 3 and 4, the manifold chambers 12*b* are recessed in the lower manifold plate 11 and open toward the upper manifold plate 12. The manifold chambers 12*a*, 12*b* are sealed by the spacer plate 13 that overlies the upper manifold plate 12.

A plurality of pressure chambers 16 are formed in the base plate 14 such that each pressure chamber 16 extends in a second (lateral) direction, perpendicularly to the center line that is parallel with the first (longitudinal) direction. End portions 16*a* of the pressure chambers 16 located on the left side in FIG. 3 are aligned with the right reference line 14*a* while end portions 16*a* of the pressure chambers 16 located on the right side are aligned with the left reference line 14*b*. The end portions 16*a* of the pressure chambers 16 on the right and left sides are arranged alternately, and the pressure chambers 16 extend in opposite directions, alternately.

Each of the pressure chambers 16, which is provided to correspond to one of the nozzles 15, is positioned to vertically overlap one of active portions of the piezoelectric actuator 20 in the plan view of the ink-jet printhead 1. Each of the pressure chambers 16 extends perpendicularly to the first direction, and the arrays of pressure chambers 16 extend along the first direction.

The end portions 16*a* of the pressure chambers 16 communicate with the nozzles 15 formed in the nozzle plate 10 in a staggered configuration via through-holes formed in the spacer plate 13 and the two manifold plates 11, 12 in a staggered configuration. The through-holes 17 have a very small diameter and serve as ink passages. The other end of each pressure chamber 16 is connected to an end portion 16*b* having a relatively large diameter via a narrow restricting portion 16*d* having a small sectional area. The end portions 16*b* communicate with the manifold chambers 12*a*, 12*b* via through-holes 18 formed as ink passages at lateral ends of the spacer plate 13. As shown in FIGS. 3, 4, the end portions 16*b* and the narrow restricting portions 16*d* are recessed and open at only a lower surface of the base plate 14. The end portions 16*b* have substantially the same diameter as the through-holes 18. The restricting portions 16*d* have a sectional area smaller than the pressure chambers 16 to prevent the ink from flowing back from the pressure chambers 16 to the manifold 12*a*, 12*b* when the piezoelectric actuator 20 is driven.

A connecting portion 16*c* having about half the thickness of the base plate 16*c* is provided in the middle of each pressure chamber 16 with respect to the longitudinal direction. The connecting portion 16*c* maintains the rigidity of the side walls of the pressure chamber 16.

The supply holes 19*b* formed at one end of the spacer plate 13 communicate with the manifold chambers 12*a* as well as the supply holes 19*a* formed at one end of the base plate 14 at the top.

Figure 5:
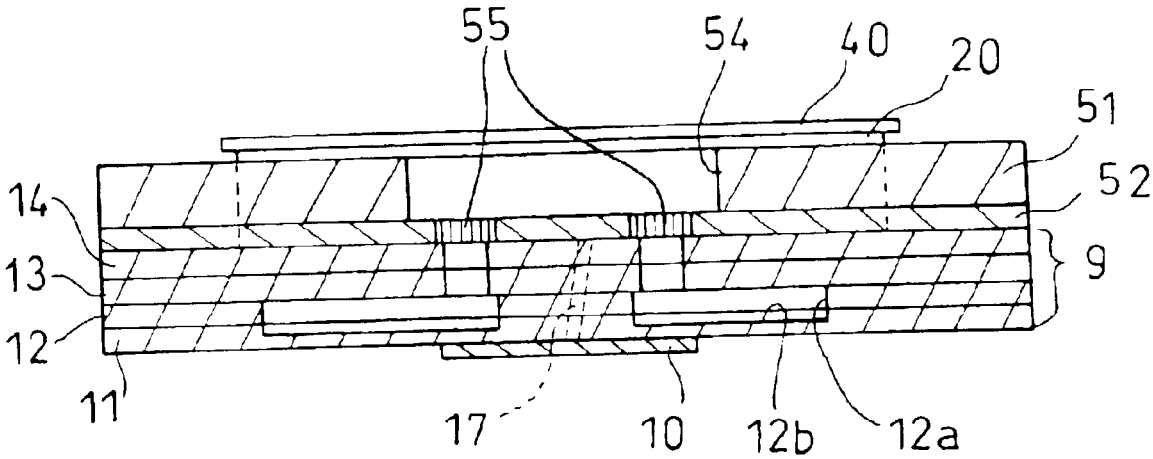
FIG. 5 is an enlarged side sectional view of the piezoelectric ink-jet printhead taken along line V—V of FIG. 1.

The straightening member 50 will now be described with reference to FIGS. 1, 4 and 5. The straightening member 50, which serves to retain the shape of the printhead 1, is shaped like a frame that is substantially rectangular in the plan view. The straightening member 50 is formed by bonding a metal member 51 and a seat member 52. The metal member 51 is made of metal, such as stainless steel and relatively thick, and the seat member 52 is made of synthetic resin, such as polyimide, and relatively thin. The seat member 52 is bonded to a lower surface of the metal member 51 using an adhesive.

The straightening member 50 is designed to have the total linear expansion coefficient that is equal to the linear expansion coefficient of the cavity unit 9. The piezoelectric actuator 20 is made of sintered ceramic, and thus the linear expansion coefficient of the piezoelectric actuator 20 is much smaller than that of the cavity unit 9, which is made of metal.

The straightening member 50 is shaped like a frame and has a large hole 53 that is substantially rectangular in the plan view. A supply hole 54 is formed on one side of the metal member 51 at a position corresponding to the supply holes 19*a*. The supply hole 54 is oval-shaped and penetrates the metal member 51. Filters 55 are formed on one side of the sheet 52 to communicate with the supply hole 54. As the filters 55, many holes having a very small diameter are formed to penetrate the sheet 52 in its thickness direction. The filters 55 are formed integrally with the synthetic resin sheet 52 by plasma or laser machining.

With this structure, foreign substances are removed at the filters 55 from the ink supplied from the ink source (not shown) to the supply hole 54. Then, as shown in FIGS. 2 and 3, the ink passes through the supply holes 19*a*, 19*b* in the cavity unit 9 and flows into the manifold chambers 12*a*, 12*b* formed on lateral sides of the manifold plates 12, 11. Because the filters 55 are located near the upper surface of the cavity unit 9 to cover the supply holes 19*a*, 19*b*, an air-trapping space is reduced and ink clogging in the ink passage is prevented. The ink further passes through the through-holes 18 and is distributed to the pressure chambers 16. The ink in the ink chambers 16 flows through the through-holes 17 and reaches the nozzles 15.

The supply hole 54 in the straightening member 50 is oval-shaped and aligned with the two supply holes 19*a* to supply an ink of the same color to the manifold chambers 12*a*, 12*b* provided on the lateral sides. Alternatively, two supply holes may be formed in the straightening member 50 to be separately aligned with the two supply holes 19*a* to supply inks of different colors to the manifold chambers 12*a*, 12*b*.

The piezoelectric actuator 20 has a known structure similar to the structure disclosed in U.S. Pat. No. 5,402,159, incorporated herein by reference. As shown in FIG. 4, the piezoelectric actuator 20 is formed by laminating a plurality of piezoelectric ceramic sheets (four to ten sheets) 21, each having a thickness of 30 μm. In addition, a top sheet 22 is placed at the top. Narrow individual electrodes (not shown) are arrayed on the upper surface (wide surfaces) of each of the lowermost sheet 21 and the odd-numbered sheets 21 counting from the lowermost sheet 21, along the longitudinal direction of the piezoelectric sheets 21, at positions corresponding to the pressure chambers 16 in the cavity unit 21.

A common electrode (not shown) is formed on the upper surface of each of the even-numbered sheets 21 counting from the lowermost sheet 21 so as to overlap the individual electrodes in the plan view.

On the upper surface of the top sheet 22, surface electrodes 30 are formed to correspond to the individual electrodes, and surface electrodes 31 are formed to correspond to lead-out portions of the common electrodes. Each surface electrode 30 and corresponding individual electrodes, which are vertically aligned, are electrically connected via a through-hole with a conductive material. Likewise, each surface electrode 31 and corresponding lead-out portions of the common electrodes, which are vertically aligned, are electrically connected via a through-hole with a conductive material.

The piezoelectric actuator 20 is formed by screen printing using a conductive paste, such as a silver-palladium paste, the individual electrodes, the common electrodes, and the surface electrodes 30, 31 on the piezoelectric ceramic sheets 21. Then, the piezoelectric ceramic sheets 21 are laminated, and the laminated sheets 21 are sintered.

A manufacturing method of the piezoelectric ink-jet printhead 1 will now be described. The straightening member 50 is previously formed as a single unit by bonding the metal member 51 and the seat member 52 using a thermosetting adhesive, such as epoxy resin, and by heating them. Then, a thermosetting adhesive, such as epoxy resin, is applied to the lower surface (wide surface facing the pressure chambers 16) of the piezoelectric actuator 20 entirely and to the lower surface of the seat member 52 of the straightening member 50. The piezoelectric actuator 20 and the straightening member 50 are stacked on the upper surface (surface formed with the pressure chambers) of the cavity unit 9 such that the piezoelectric actuator 20 is placed into the large hole 53 of the straightening member 50. By the application of the heat to the piezoelectric actuator 20 and the straightening member 50 while they are pressed against the cavity unit 9, the piezoelectric actuator 20 and the straightening member 50 are bonded to the cavity unit 9. As a result, the frame-shaped straightening member 50 and the piezoelectric actuator 20 enclosed by the frame of the straightening member 50 are fixed to the upper surface of the cavity unit 9. In the first embodiment, as shown in FIG. 4, the straightening member 50 is designed to have the total thickness T1 that is slightly smaller than the thickness of the piezoelectric actuator 20. This allows the flexible flat cable 40 to extend outwardly over the straightening member 50 substantially flat when the flexible flat cable 40 is stacked on and pressed against the upper surface of the piezoelectric actuator 20. Thus, various wiring patterns (not shown) of the flexible flat cable 40 are securely electrically connected to the surface electrodes 30, 31.

In the conventional piezoelectric ink-jet printhead, the piezoelectric actuator 20 usually has less rigidity (section modulus) than the cavity unit 9 and lower linear expansion coefficient than the cavity unit 9. Because the cavity unit 9 expands linearly by a greater extent than the piezoelectric actuator 20 and the piezoelectric actuator 20 has lower resistance against curving, the cavity unit 9 curves concavely on the nozzle side. In contrast, in this embodiment, the straightening member 50 whose metal member 51 has substantially the same linear expansion coefficient as the cavity unit 9 is used, and the straightening member 50 is attached to the upper surface (surface bonded to the piezoelectric actuator 20) of the cavity unit 9. In this case, the total rigidity (section modulus) of the piezoelectric actuator 20 and the straightening member 50 is set closer to the rigidity of the cavity unit 9, and the total linear expansion coefficient of the piezoelectric actuator 20 and the straightening member 50 is set closer to the linear expansion coefficient of the cavity unit 9. As a result, the difference in the amount of expansion/contraction, caused during heating and cooling in the bonding process, between the cavity unit 9 and the piezoelectric actuator 20 combined with the straightening member 50 is reduced. Thus, curving or warping of the cavity unit 9 on the nozzle side is corrected, and high print (image forming) quality is maintained.

In addition, warping under temperature changes of the entire body formed by bonding the straightening member 50, the cavity unit 9, and the piezoelectric actuator 20 can be reduced or eliminated when the straightening member 50, the cavity unit 9, and the piezoelectric actuator 20 are set to be greatest, second greatest, and smallest in linear expansion coefficient, respectively. Warping of the entire body can also be reduced or eliminated when the piezoelectric actuator 20, the cavity unit 9, and the straightening member 50 are set to be greatest, second greatest, and smallest in linear expansion coefficient, respectively. In other words, warping of the ink-jet printhead 1 is corrected when a difference in linear expansion coefficient between the straightening member 50 and the piezoelectric actuator 20 is greater than a difference in linear expansion coefficient between the cavity unit 9 and the piezoelectric actuator 20.

In addition, because the straightening member 50 is shaped like a frame that encloses the circumference of the piezoelectric actuator 20, the rigidity of the straightening member 50 is enhanced and thus the straightening member 50 provides a higher straightening effect. As shown in FIG. 4, there is a clearance between the piezoelectric actuator 20 and the frame of the straightening member 50. Thus, expansion/contraction under temperature changes of the piezoelectric actuator 20 and the straightening member 50 at their free end is absorbed in this clearance. Further, the straightening member 20 has the function of protecting the circumference of the piezoelectric actuator 20.

In the piezoelectric ink-jet printhead 1 structured as described above, portions of the piezoelectric sheet 21 sandwiched between the individual electrodes and the common electrodes are polarized by applying high voltage between all the individual electrodes and the common electrodes via the surface electrodes 30, 31. The polarized portions become active portions. When a drive voltage is applied between selected individual electrodes and the common electrodes via the corresponding surface electrode 30 and the surface electrodes 31, an electric field is generated in the corresponding active portion in a direction parallel to the polarization direction, and the active portion expands in the laminating direction of the piezoelectric sheets 21, 22. The volume of the corresponding pressure chamber 16 is reduced, and the ink in the pressure chamber 16 is ejected from the corresponding nozzle 16 as an ink droplet to perform printing.

Figure 6:
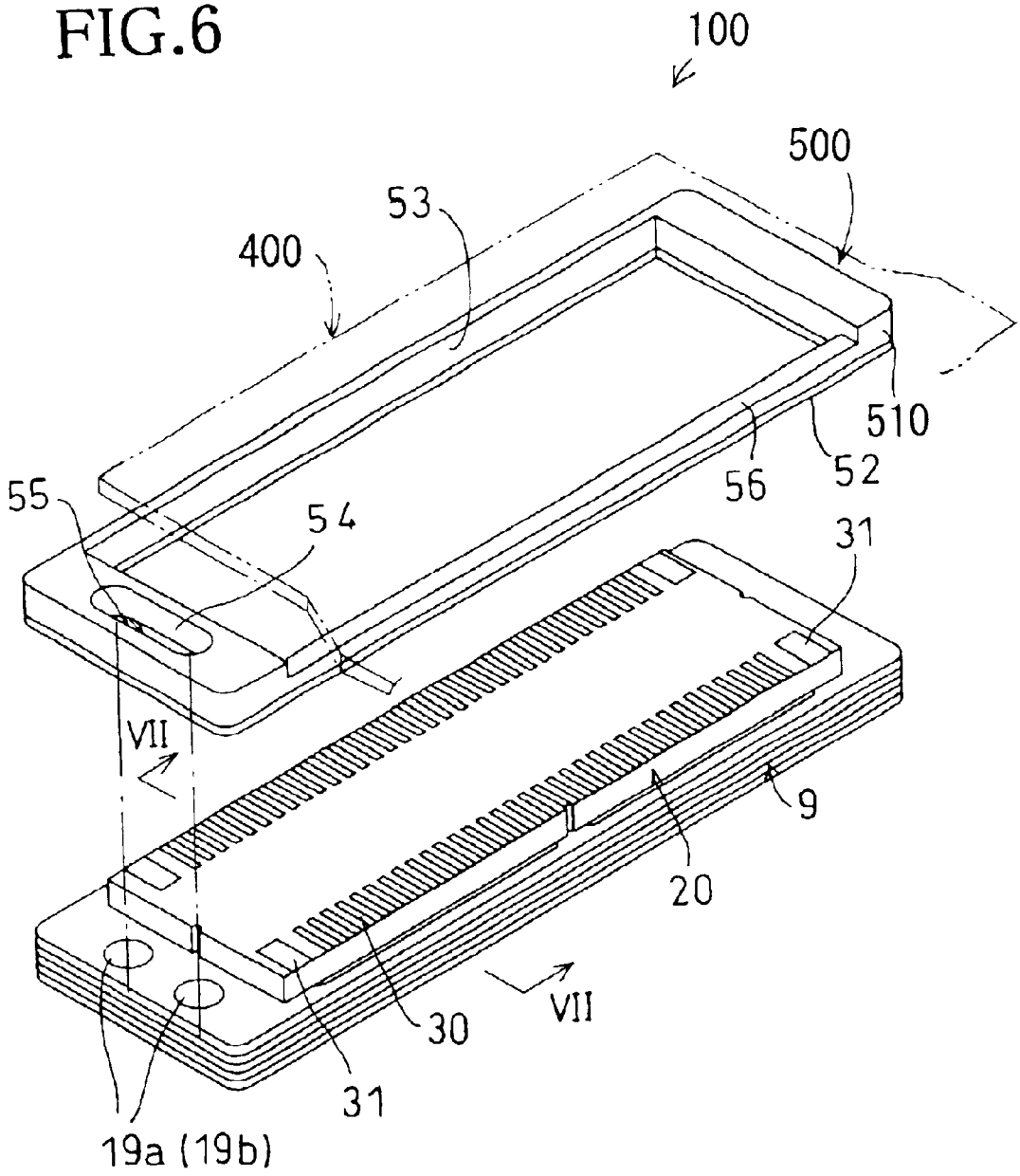
FIG. 6 is a perspective view of a piezoelectric ink-jet printhead according to a second embodiment of the invention.
Figure 7:
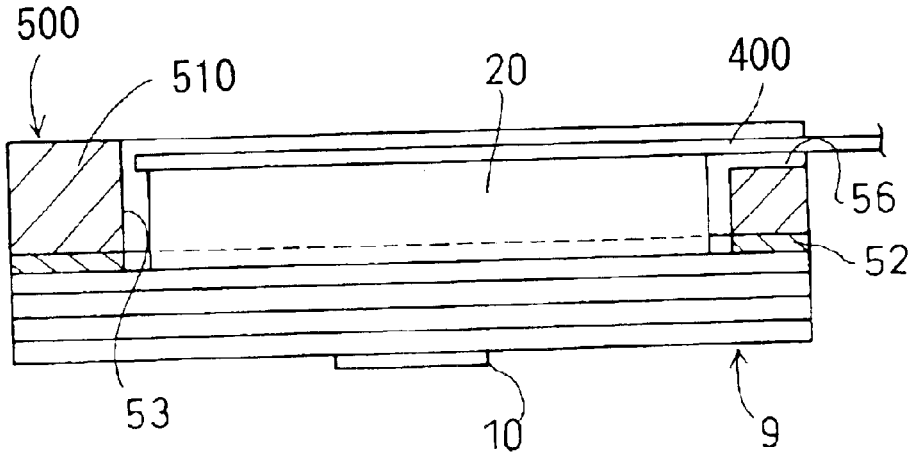
FIG. 7 is an enlarged side sectional view of the ink-jet printhead taken along line VII—VII of FIG. 6.

FIGS. 6 and 7 show a piezoelectric ink-jet printhead 100 according to a second embodiment of the invention. The piezoelectric ink-jet printhead 100 of the second embodiment has the same structure as the piezoelectric ink-jet printhead 1 of the first embodiment, except for a straightened member 500. The same elements as those in the first embodiment are labeled with the same numbers, and the elements already described in the first embodiment will be omitted for clarity.

As shown in FIGS. 6 and 7, the straightening member 500 of the second embodiment differs from the straightening member 50 of the first embodiment in that a metal member 510 of the straightening member 500 is cut away on one side at its upper surface to form a stepped portion 56. The lower surface of a flexible flat cable 400, which is bonded to the upper surface of the piezoelectric actuator 20 placed in the large hole 53 of the straightening member 500, is located higher than the stepped portion 56 of the straightening member 500. In addition, the upper surface of the flexible flat cable 49 is located lower than the upper surface of the rest of the straightening member 500. This structure allows the flexible flat cable 400 to be placed on the upper surface of the piezoelectric actuator 20 and extend outwardly over the stepped portion 56 of the straightening member 500 substantially flat. Thus, various wiring patterns (not shown) of the flexible flat cable 40 are securely electrically connected to the surface electrodes 30, 31. The extending direction of the flexible flat cable 400 depends on the position of a connector (not shown) on a carriage (not shown) to which the flexible flat cable is connected.

In an alternate embodiment of the invention not shown in the drawing, a straightening member having a pair of linear rodlike portions may be bonded to the upper surface of the cavity unit 9 in parallel with two longitudinal sides of the piezoelectric actuator 20, which is bonded to the upper surface of the cavity unit 9. Such a straightening member can straighten the cavity unit 9 that may suffer curving or warping on the nozzle side.

In the above-described embodiments, because the piezoelectric actuator 20 and the straightening member 50 is bonded to the upper surface of the cavity unit 9 using the same thermosetting adhesive successively, assembly of the ink-jet printhead is made easy and simple. Further, because the filters 55 are formed integrally with the synthetic resin seat member 52 of the straightening member 50, 500 to cover the supply holes 19*a*, 19*b* in the cavity unit 9, there is no need to provide filters for the supply holes 19*a*, 19*b*, separately. Accordingly, the number of manufacturing processes as well as the manufacturing cost of the ink-jet printhead can be reduced.

As described in the embodiments, curving or warping of the ink-jet printhead, which is flat in shape, is corrected when its components, such as the piezoelectric actuator 20 and the cavity unit 9, are bonded. Accordingly, proper ink trajectories and high print quality are maintained.

Whereas, in the above-described embodiments, the straightening member 50, 500 is formed by the metal member 51, 510 and the seat member 52 made of synthetic resin, the straightening member 50, 500 may be formed by a single member that is made of metal or synthetic resin. However, adhesion properties of the straightening member 50, 500 are improved by forming the straightening member 50, 500 as in the embodiments and by bonding the seat member 52 made of synthetic resin to the cavity unit 9.

Further, the materials of the cavity unit 9, the piezoelectric actuator 20, and the straightening member 50 may be arbitrarily chosen as long as the effect of straightening the ink-jet printhead is provided. For example, the seat member 52 may be formed by a thin metal member, instead of a thin synthetic resin member.

While the invention has been described with reference to the specific embodiments, the description of the embodiments is illustrative only and is not to be construed as limiting the scope of the invention. Various other modifications and changes may be possible to those skilled in the art without departing from the spirit and scope of the invention.

What is claimed is:

1. An ink-jet printhead comprising:

a cavity unit having an array of nozzles and pressure chambers each storing ink and communicating with a corresponding one of the nozzles;

an actuator shaped like a plate and having active portions each provided for a corresponding one of the pressure chambers and selectively driven to pressurize the ink in the pressure chambers, the actuator being stacked on and bonded to a surface formed with the pressure chambers of the cavity unit; and a straightening member operable to retain the shape of the printhead and bonded to the surface formed with the pressure chambers of the cavity unit to enclose at least two sides of the actuator along at least a longitudinal direction of the cavity unit.

2. The ink-jet printhead according to claim 1, wherein the straightening member is shaped like a frame that encloses a circumference of the actuator.

3. The ink-jet printhead according to claim 2, further comprising a flat cable that is bonded to a surface of the actuator facing away from the cavity unit, wherein the straightening member is slightly thinner than the actuator in a direction perpendicular to the longitudinal direction of the cavity unit, and the flat cable extends substantially flat over the straightening member.

4. The ink-jet printhead according to claim 1, wherein the straightening member is substantially equal in linear expansion coefficient to the cavity unit.

5. The ink-jet printhead according to claim 4, wherein the actuator is made of ceramic, the cavity unit is made of metal, and the straightening member is made of at least one of metal and synthetic resin.

6. The ink-jet printhead according to claim 1, wherein the difference in linear expansion coefficient between the straightening member and the actuator is greater than the difference in linear expansion coefficient between the cavity unit and the actuator.

7. The ink-jet printhead according to claim 6, wherein the actuator is made of ceramic, the cavity unit is made of metal, and the straightening member is made of at least one of metal and synthetic resin.

8. The ink-jet printhead according to claim 1, wherein the straightening member is formed by bonding a metal member and a synthetic resin member.

9. The ink-jet printhead according to claim 8, wherein the cavity unit has an ink supply hole open at the surface formed with the pressure chambers, and the synthetic resin member of the straightening member is bonded, as a seat member, to the surface formed with the pressure chambers of the cavity unit, the seat member being formed with a filter that covers the ink supply hole.

10. The ink-jet printhead according to claim 9, further comprising a flat cable that is bonded to a surface of the actuator facing away from the cavity unit, wherein the metal member of the straightening member is bonded to the seat member and has a stepped portion over which the flat cable extends substantially flat.

11. A method of manufacturing an ink-jet printhead, comprising:

providing a cavity unit that has an array of nozzles and pressure chambers each communicating with a corresponding one of the nozzles;

providing an actuator shaped like a plate and having active portions that are selectively driven;

forming a straightening member operable to retain the shape of the printhead and having at least two linear portions; and bonding the actuator and the straightening member to a surface formed with the pressure chambers of the cavity unit, such that the straightening member encloses with the two linear portions at least two sides of the actuator along at least a longitudinal direction of the cavity unit and that each of the active portions is positioned at a corresponding one of the pressure chambers.

12. The method according to claim 11, wherein the straightening member is formed into a frame shape and encloses a circumference of the actuator when bonded to the cavity unit.

13. The method according to claim 12, further bonding a flat cable to a surface of the actuator facing away from the cavity unit, wherein the straightening member is formed to be slightly thinner than the actuator in a direction perpendicular to the longitudinal direction of the cavity unit, and the flat cable extends substantially flat over the straightening member when the actuator and the straightening member are bonded to the cavity unit.

14. The method according to claim 11, wherein the straightening member is formed from a material that is substantially equal in linear expansion coefficient to the cavity unit.

15. The method according to claim 11, wherein the straightening member is formed by bonding a metal member and a synthetic resin member.

16. The method according to claim 15, wherein the synthetic resin member of the straightening member is formed with a filter, and the cavity unit has an ink supply hole open at the surface formed with the pressure chambers, the ink supply hole facing the filter when the synthetic resin member of the straightening member is bonded to the surface formed with the pressure chambers of the cavity unit.

17. The method according to claim 16, further comprising bonding a flat cable to a surface of the actuator facing away from the cavity unit, wherein the metal member of the straightening member is formed with a stepped portion such that the flat cable extends substantially flat over the stepped portion when the actuator and the straightening member are bonded to the cavity unit.

18. The method according to claim 11, wherein the straightening member is formed from a material that differs in linear expansion coefficient from the actuator more greatly than the cavity unit differs in linear expansion coefficient from the actuator.

19. The method according to claim 11, wherein the step of bonding includes bonding the actuator and the straightening member using a thermosetting adhesive.

20. An ink-jet printhead comprising:

a cavity unit having a plurality of nozzles spaced apart in a longitudinal direction and a plurality of pressure chambers each storing ink and communicating with a corresponding nozzle;

an actuator bonded to the cavity unit and operable to selectively pressurize the ink in the pressure chambers for ejection through the nozzles; and a shape retainer bonded to the cavity unit and extending along at least two sides of the cavity unit in the longitudinal direction, the shape retainer operable to retain the shape of the printhead.

21. The ink-jet printhead according to claim 20 wherein the difference in linear expansion coefficient between the shape retainer and the actuator is greater than the difference in linear expansion coefficient between the cavity unit and the actuator.

22. The ink-jet printhead according to claim 20, wherein:

the shape retainer includes a metal member and a synthetic resin member bonded to the metal member, the synthetic resin member having a filter;

the cavity unit has an ink supply hole in communication with the plurality of pressure chambers; and the synthetic resin member is bonded to the cavity unit such that the filter of the synthetic resin member covers the ink supply hole.

23. The ink-jet printhead according to claim 20 wherein the shape retainer and the actuator are bonded to the same surface of the cavity unit and the shape retainer surrounds the actuator.

24. A method of manufacturing an ink-jet printhead comprising:

forming a cavity unit having a plurality of nozzles that are spaced apart in a longitudinal direction and a plurality of pressure chambers each operable to store ink and communicate with a corresponding nozzle;

applying an adhesive on an actuator which is operable to selectively pressurize the ink in the pressure chambers for ejection through the nozzles;

applying an adhesive on a shape retainer, the shape retainer operable to retain the shape of the printhead; and bonding the actuator and the shape retainer to the cavity unit by heating while the actuator and the shape retainer are pressed against the cavity unit such that the shape retainer extends along at least two sides of the cavity unit in the longitudinal direction.

25. The method according to claim 24, further comprising forming the shape retainer from a material that is substantially equal in linear expansion coefficient to the cavity unit.

26. The method according to claim 24, further comprising forming the shape retainer from a selected material wherein the difference in linear expansion coefficient between the selected material and the actuator is greater than the difference in linear expansion coefficient between the cavity unit and the actuator.

27. The method according to claim 24, wherein the steps of applying an adhesive include applying a thermosetting adhesive.

28. The method according to claim 24, further comprising forming the shape retainer having a frame shape so as to surround the actuator when bonded to the cavity unit.

* * * * *